US008307471B2

(12) United States Patent
Seymour et al.

(10) Patent No.: US 8,307,471 B2
(45) Date of Patent: Nov. 13, 2012

(54) BATHER MOVEMENT APPARATUS

(75) Inventors: Michael Wm. Seymour, Aliso Viejo, CA (US); Deon Colchester, Huntington Beach, CA (US); Robert Rotstan, Jr., Aliso Viejo, CA (US); Carl Tenbrink, Huntington Beach, CA (US)

(73) Assignee: Axcess Innovations Inc., Huntington Beach, CA (US)

( * ) Notice: Subject to any disclaimer, the term of this patent is extended or adjusted under 35 U.S.C. 154(b) by 244 days.

(21) Appl. No.: 12/611,858

(22) Filed: Nov. 3, 2009

(65) Prior Publication Data

US 2011/0056013 A1 Mar. 10, 2011

Related U.S. Application Data

(60) Provisional application No. 61/241,215, filed on Sep. 10, 2009.

(51) Int. Cl.
*A47K 3/02* (2006.01)

(52) U.S. Cl. ..... 4/563.1; 4/578.1; 4/555

(58) Field of Classification Search ..... 4/555, 556, 4/560.1–563.1, 571.1, 578.1
See application file for complete search history.

(56) References Cited

U.S. PATENT DOCUMENTS

| | | | | |
|---|---|---|---|---|
| 3,022,518 | A | 2/1962 | Hayden | |
| 3,480,973 | A * | 12/1969 | Stairs | 4/567 |
| 3,918,108 | A * | 11/1975 | Feyerherm | 4/563.1 |
| 3,994,030 | A | 11/1976 | Cassell et al. | |
| 4,101,988 | A | 7/1978 | Sierant | |
| 4,206,523 | A | 6/1980 | James | |
| 4,254,517 | A | 3/1981 | Herman, Jr. | |
| D261,377 | S | 10/1981 | Grant | |
| 4,495,666 | A | 1/1985 | Herman, Jr. | |
| 4,534,074 | A | 8/1985 | Herman, Jr. | |
| 4,628,550 | A | 12/1986 | Walton | |
| 4,733,418 | A | 3/1988 | Luther | |
| 4,768,239 | A | 9/1988 | Pauley | |
| 4,780,916 | A * | 11/1988 | Sutton | 4/541.5 |
| 5,146,638 | A | 9/1992 | Richards | |
| 5,168,585 | A | 12/1992 | Cox | |
| 5,226,183 | A | 7/1993 | Clark | |
| D340,141 | S | 10/1993 | Chapman | |
| 5,263,207 | A | 11/1993 | Gilbert | |
| 5,267,360 | A | 12/1993 | Bassil et al. | |
| 5,341,525 | A | 8/1994 | Tillman et al. | |
| 5,390,978 | A | 2/1995 | Janisch | |
| 5,579,544 | A | 12/1996 | Attler | |
| 5,797,149 | A | 8/1998 | Mustarde | |
| 5,855,028 | A | 1/1999 | Colbert | |
| 5,896,780 | A | 4/1999 | Hooker | |
| 5,924,147 | A | 7/1999 | Clark et al. | |
| 6,003,168 | A | 12/1999 | Steadman | |
| 6,049,923 | A | 4/2000 | Ochiai | |
| 6,067,671 | A | 5/2000 | Ginder | |
| D437,467 | S | 2/2001 | Steadman | |
| 6,199,226 | B1 | 3/2001 | Steadman | |

(Continued)

*Primary Examiner* — Gregory Huson
*Assistant Examiner* — Janie Christiansen
(74) *Attorney, Agent, or Firm* — Walter A. Hackler

(57) ABSTRACT

Bather movement apparatus for use with a sidewall opening bath enclosure generally includes a chaise, a stanchion having a stirrup for supporting the chaise along with a pivot post extending exterior to the bath enclosure and a pivot arm interconnecting the pivot post and stanchion for enabling arcuate movement of the chaise between a bathing position within the bath enclosure and a doorway position outside of the bath enclosure. The movement of the chaise passes the chaise through the bath enclosure side opening.

14 Claims, 12 Drawing Sheets

U.S. PATENT DOCUMENTS

| | | | |
|---|---|---|---|
| 6,256,807 | B1 | 7/2001 | Steadman |
| 6,397,409 | B1 | 6/2002 | Sherlock et al. |
| 6,397,410 | B1 | 6/2002 | Steadman |
| 6,408,456 | B1 | 6/2002 | Fike et al. |
| 6,425,146 | B1 | 7/2002 | O'Brien et al. |
| 6,643,860 | B2 | 11/2003 | Sherlock et al. |
| 6,643,861 | B2 | 11/2003 | Sherlock et al. |
| 6,715,164 | B2 | 4/2004 | Steadman et al. |
| 6,766,543 | B1 | 7/2004 | Hollis et al. |
| 6,817,045 | B1 | 11/2004 | Fainberg |
| 7,197,775 | B2 | 4/2007 | Steadman |
| 2004/0060107 | A1 | 4/2004 | Eisenberg |

* cited by examiner

FIG. 4.
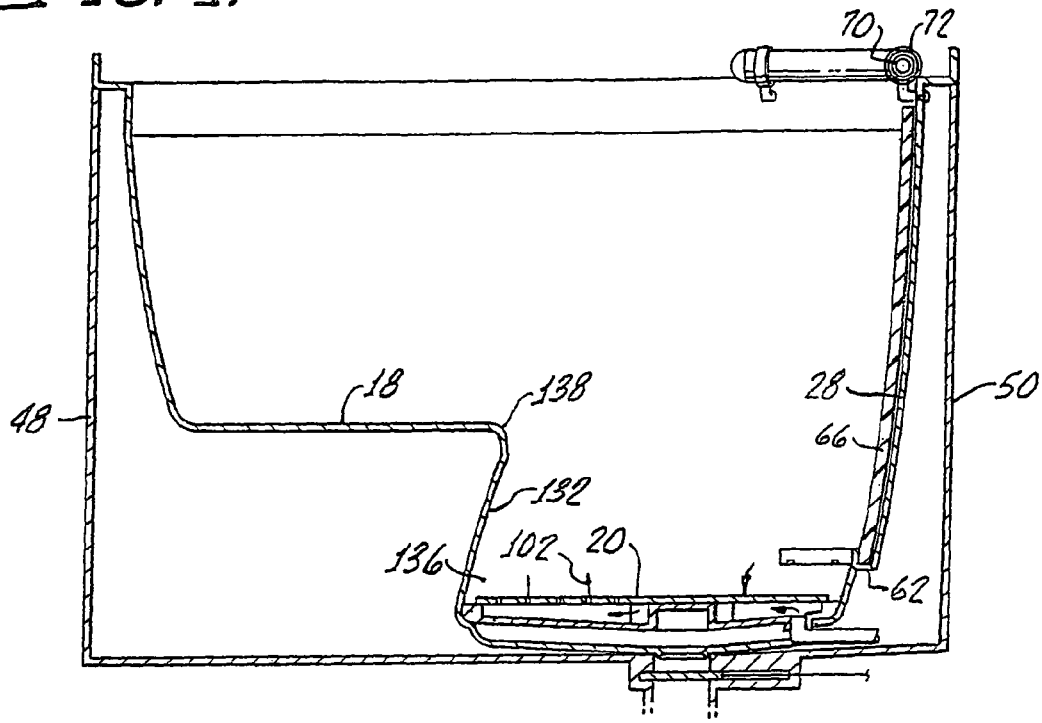
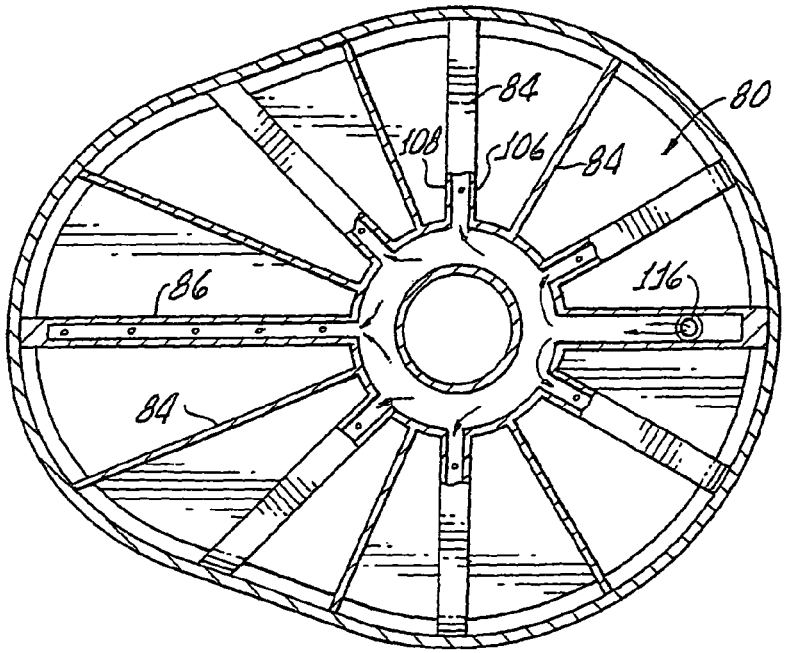
FIG. 9.

BATHER MOVEMENT APPARATUS

The present application claims priority from U.S. Ser. No. 61/241,215 filed Sep. 10, 2009. This application is to be incorporated herein in its entirety.

The present invention generally relates to a bath system and is more particularly directed to bather movement apparatus for enabling transfer of elderly and disabled persons into and out of the bathtub and more specifically to help lowering a person down into a bathtub for emersion and thereafter lifting the person out of the bath enclosure and through a side door to a position exterior to the bath closure.

Typical bathtub bathing procedures are often difficult for some elderly and disabled persons not only due to the typically high wall structure of a bathtub but rising from a seated position when within the bathtub requires considerable strength, balance, and range of motion which may be limited by some by aging or disability.

A great number of bath lift systems have been developed which are typically exposed lifting devices disposed adjacent a bathtub which are not particularly aesthetically appealing.

Most, bath lift systems are designed for use with rigid wall bathtubs and accordingly do not provide convenient use thereof.

The present invention provides for a bather movement apparatus and sidewall opening bath enclosure which not only is effective in transport of a bather into and out of a bath enclosure but also for providing therapy message and chaise reclining of the bather.

SUMMARY OF THE INVENTION

A bather movement apparatus, which may include a sidewall opening bath enclosure, generally includes a chaise along with a stanchion having a stirrup for supporting the chaise.

A pivot post is provided which extends exterior to bath enclosure and a pivot arm interconnects the pivot post with the stanchion for enabling arcuate movement of the chaise between a bathing position within the enclosure, and a doorway position, outside the bath enclosure. Movement includes passing the chaise through the bath enclosure side opening in this manner. A bather may be transferred from a wheelchair to the chaise outside the bathtub and thereafter transported within the bathtub.

More particularly, the apparatus includes a roller disposed at stanchion bottom along with an arcuate track disposed on the bath enclosure bottom for supporting the roller chaise within the bath enclosure. The roller preferably is extendable from the stanchion bottom for bearing on a floor outside of the bath enclosure thus enabling the bodyweight supported from beneath at all times.

In addition, a guide wheel is provided and disposed at the stanchion bottom along with an arcuate steering guide next to the track. The guide wheel engages the steering guide during movement of the chaise within the bath enclosure and rotates the chaise 90° from the bathing position to the doorway position.

A piston may be provided and disposed in the stanchion for raising and lowering the stirrup and chaise and additionally, the chaise may be hinged mounted to the stirrup for enabling supine positioning of the chaise within the bath enclosure.

Further features of the present invention provide for an articulated chaise for enabling a bather, positioned in the chaise, to assume various anatomical contours. The chaise may also include massage nozzles for providing therapy for a bather with a nozzle interconnected by molded fluid channels on a chaise back which in turn are in fluid communication with the stanchion arm and pivot post.

BRIEF DESCRIPTION OF THE DRAWINGS

The advantages and features of the present invention will be better understood by the following description when considered in conjunction with the accompanying drawings in which:

FIG. 4 is a cross sectional view of the enclosure of FIG. 2 and adjacent sliding door more clearly illustrating a parabolic surface of revolution shape of the sidewall around a standing area along with the seat wall interconnecting a seating area with a standing area and also a grate over the standing area;

FIG. 9 is a cross sectional view taken along the line 9-9 of FIG. 8 illustrating how support ribs and holes in the grate for providing bubbling in the enclosure;

DETAILED DESCRIPTION

Figure 1:
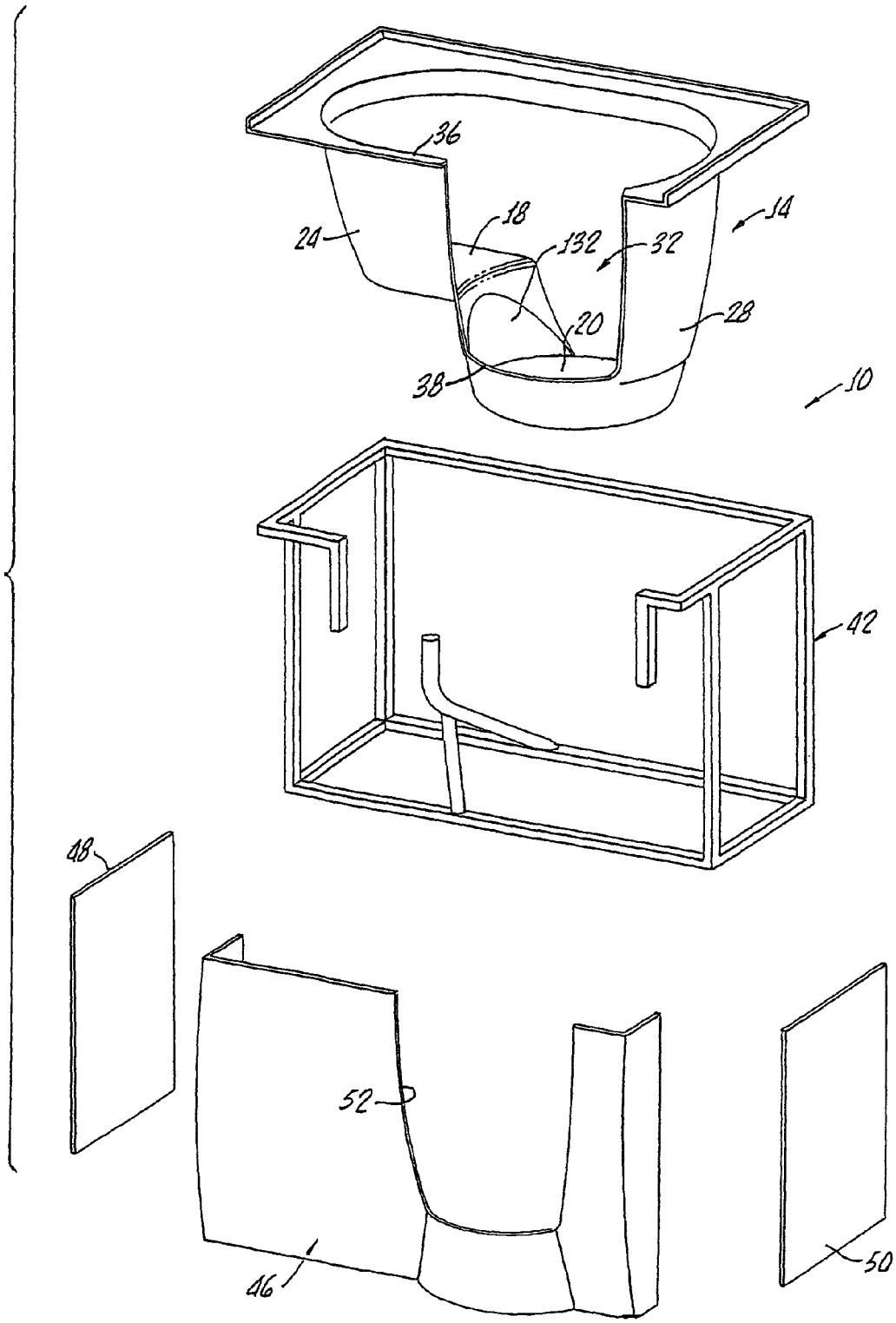
FIG. 1 is an exploded view of a side opening bath enclosure in accordance with the present invention illustrating individual components such as a shell, frame, front and side panels, that can be carried into a room and assembled on-site.
Figure 2:
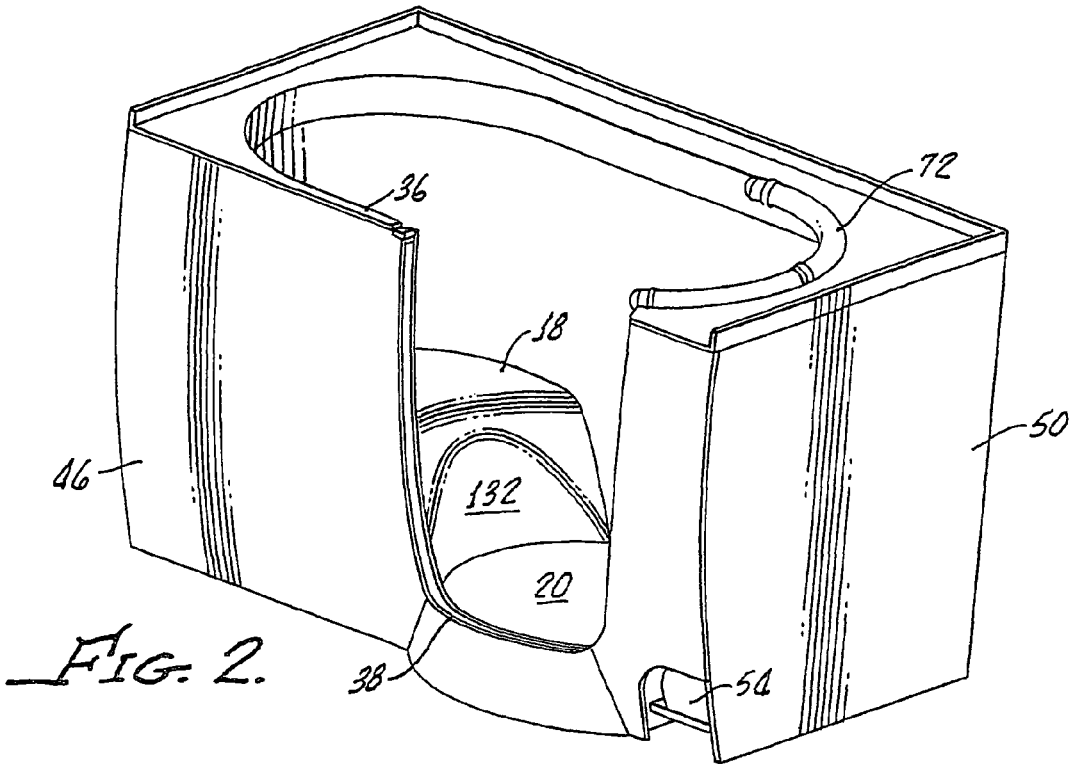
FIG. 2 is a perspective view of an assembled enclosure showing an open side opening.
Figure 3:
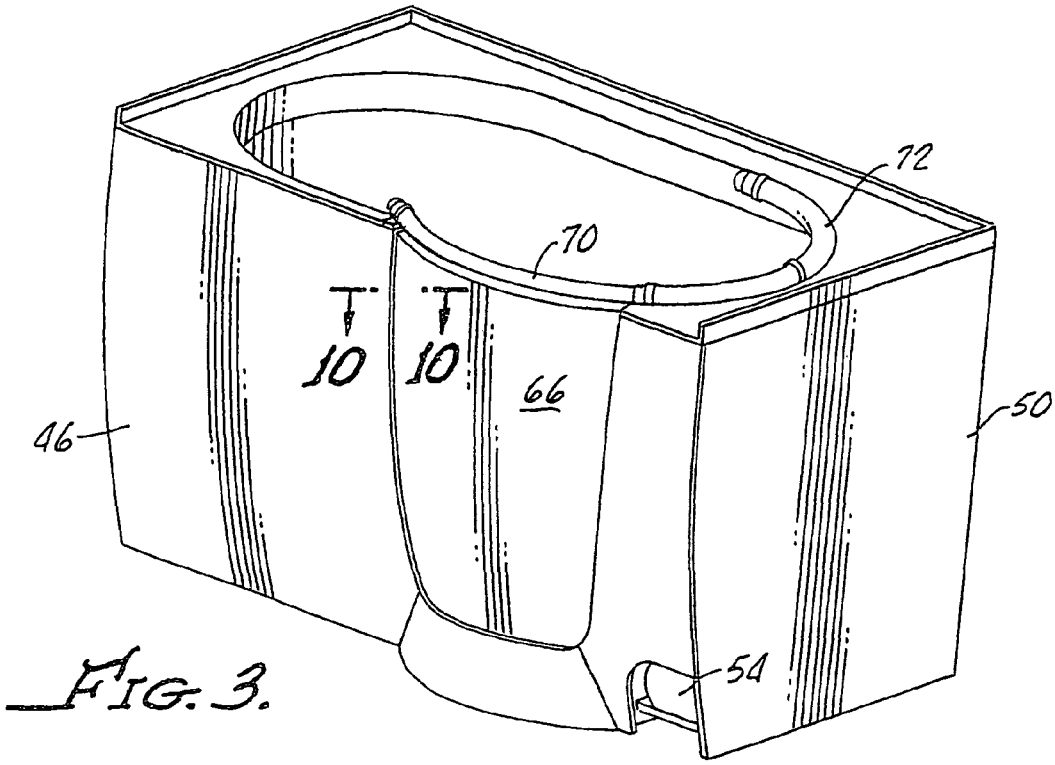
FIG. 3 is a perspective view similar to FIG. 2 illustrating closure of the side opening by a pocket door.
Figure 5:
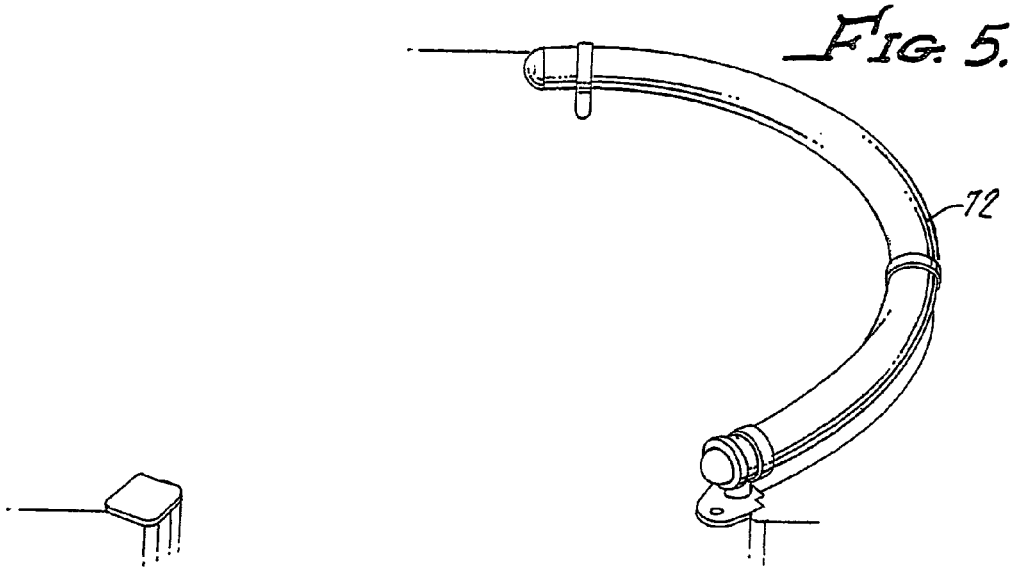
FIG. 5 is an enlarged perspective view of a shell handrail.
Figure 6:
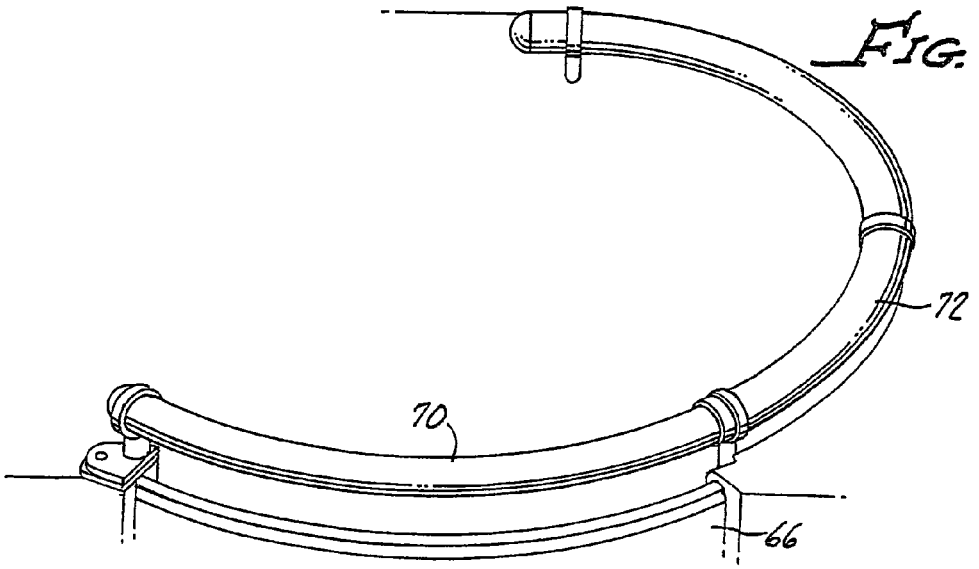
FIG. 6 is a perspective view of a door handrail.

With reference to FIGS. 1-3, there is shown an exploded view of a side opening bath enclosure 10 in accordance with the present invention which generally includes a shell 14 having a seating area 18 and a standing area 20 with a contiguous sidewall 24. A sidewall portion 28 around the standing area 20 includes an access opening 32 extending from a shell top 36 to an opening bottom 38 which is proximate the standing area 20. A frame 42 is provided for supporting the shell 14 along with a front panel, or fascia, 46 and side panels 48, 50 all attachable to the frame 42 in a conventional manner. The front panel 46 includes a cutout 52 for alignment with the access opening 32.

Importantly, the shell 14, frame 42, and panels 46, 48, 50 are all fabricated for onsite assembly and passage through a conventional doorway such as, for example, but not limited to a 34-inch wide doorway (not shown). The shell 14, frame 42, and panels 46, 48, 50 may be formed from any conventional material including but not limited to gel-coated fiberglass, or acrylics.

The modular nature of the enclosure 10 enables the use of fascias 46 of various designs to be utilized in order to match or compliment various bathroom decors. In addition, the fascias may be removed at any time to facilitate access to workings, pump lines, etc., not shown, for bath installation and repair. In addition, a separate opening 54 may be provided for maintenance or repair.

As shown in FIGS. 1 and 4, the sidewall portion 28 has a parabolic surface of revolution (PSR) shape, particularly around the standing area 20 which extends outwardly from the standing area 20 to provide a larger space for a bather (not shown) greater than a footprint provided by the standing area 20.

Figure 8:
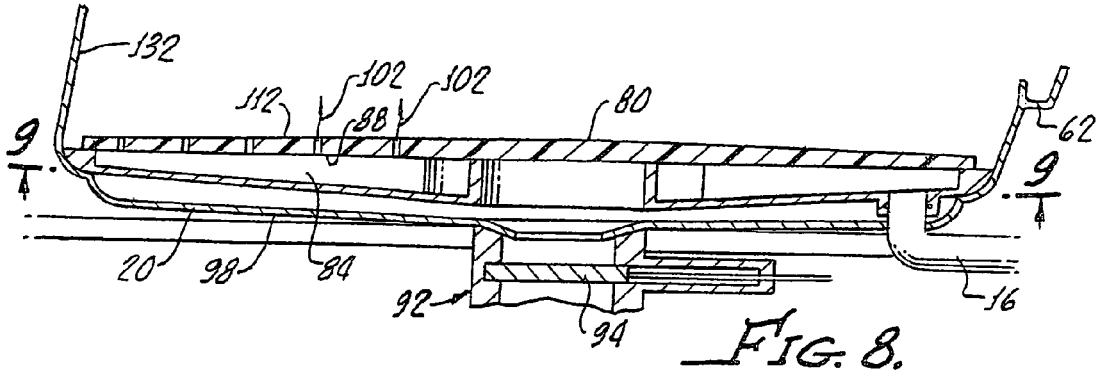
FIG. 8 is a cross sectional view of the standing area and grate shown in FIG. 4.

As best shown in FIGS. 4 and 8, the sidewall portion 28 includes a track 62 for supporting a pocket door 66, adjacent the sidewall portion 28, for enclosing the access opening 32 as also shown in FIG. 3.

The use of a pocket door 66 enables a wider access opening 32 to be utilized than would otherwise be possible with a hinged door, not shown.

A door rail 70 fixed to the pocket door 66 in any conventional manner facilitates opening and closing of the door 66. In addition, the door rail 70 provides a structural bridge across the access opening 32 when closed.

Figure 7:
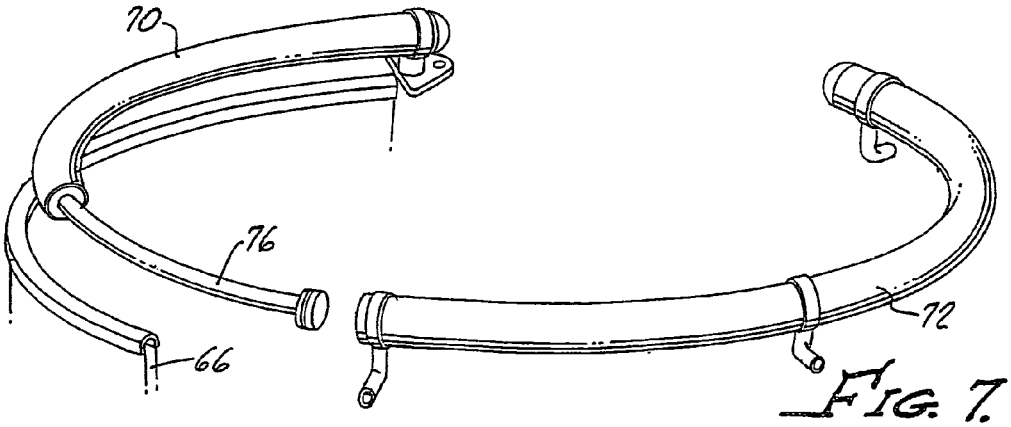
FIG. 7 is a perspective exploded view of a shell handrail and door handrail along with a piston disposed within the shell handrail for hydraulic operation of the door.

The door 66 may be manually open and closed by the rail 70; however, preferably a shell hand rail 72 is disposed in a conventional manner proximate the shell top 36 which includes a piston 76 disposed therein, see FIG. 7, with the piston being connected to the door hand rail 70 for hydraulically opening and closing the door. Hydraulic movement of the piston in the shell hand rail 72 is done in a conventional manner and specific hydraulic connections are not described herein for the sake of clarity.

With reference to FIGS. 4, 8-9, there is shown a grate 80 removably covering the standing area 20 for providing a level standing area. The grate 80 enables water passage thereto and includes a plurality of support ribs 84, 86 disposed on an underside 88 of the grate 80.

A conventional drain 92 with a drain valve 94, operable in any conventional manner, is disposed at a bottom 98 of the shell 14 and best seen in FIG. 8.

Hydraulics, including water filling and draining of the enclosure 10, may be done in any conventional manner and not described herein for the sake of clarity.

To provide bubbling in the water (not shown) within the shell 14, as illustrated by air flow arrows 102 in FIG. 8, some of the support ribs 84 as illustrated in FIG. 9 are hollow or include parallel walls 106, 108 which communicate with holes 112 in the grate (see FIG. 8) and an air supply 116 for causing bubbling in a water filled shell 14. The air pump and communicating ducts not being shown inasmuch as they are in conventional in nature.

Figure 11:
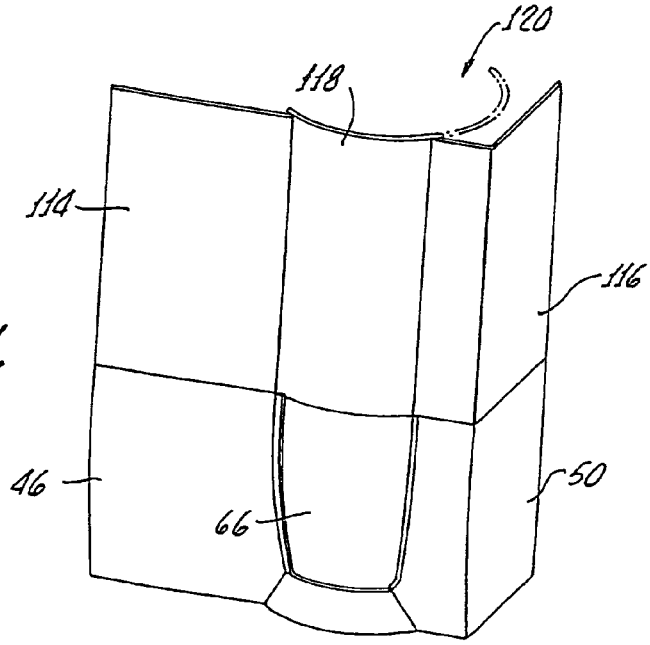
FIG. 11 illustrates the enclosure shown in FIGS. 2 and 3 along with a top front panel, top side panels, and a top door panel attachable respectively to the front panel, side panels, and door for providing a showering area for a bather.

Referring to FIG. 11, a top front panel 114, top side panel 116, and top door panel 118 may be provided and conventionally attached respectively to the front panel 46, pocket door 66, and side panel 50 in order to provide a showering area for standing bather, not shown. The top door panel 118 may optionally not be attached to the door 66 for movement therewith but be independently slideable into the top front panel 114.

Figure 10:
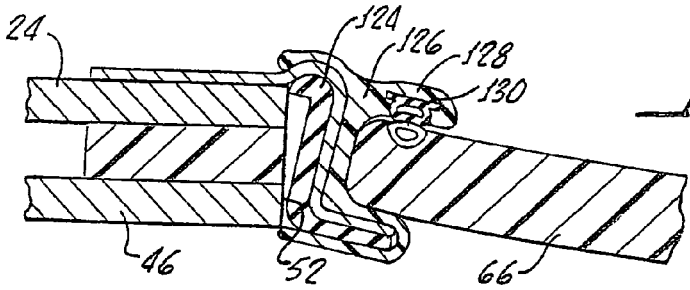
FIG. 10 is a cross sectional view taken along the line 10-10 of FIG. 3 illustrating a seal between the door and the side panel provided by inflatable gaskets.

With reference to FIG. 10, engagement between the pocket door 66 and front panel 46 is shown in cross section illustrating engagement fittings 124, 126, 128 along with an inflatable gasket 130 for sealing the door 66 in the access opening 32, the inflatable gasket 130 being conventional in manufacture and operation.

The gasket 130 is preferably hydraulic and also provides for locking of the door 66 in the access opening 32. When filled with water, the gasket 130 is effectively solid and movement is prevented between the door 66 and fillings 124, 126, 128.

With specific reference to FIG. 4, the seating area 18 is elevated from the standing area 20 and is interconnected therewith by a seat wall 132 which is "undercut" in order to enable a seated bather (not shown) to have a heel position 136 directly below a seat edge 138 to facilitate standing of the bather from a seated position.

Figure 12:
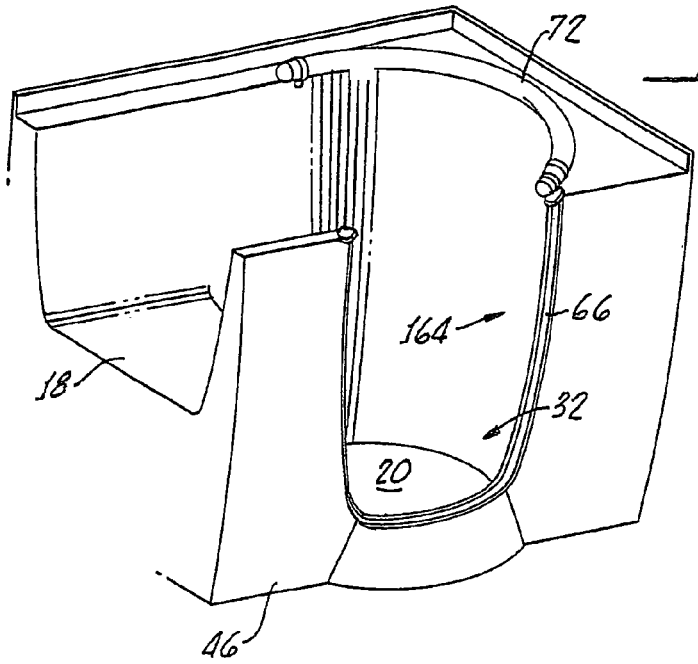
FIGS. 12-14 illustrate an alternative embodiment of the present invention showing an arcuate door sliding within a sidewall around a standing area.
Figure 13:
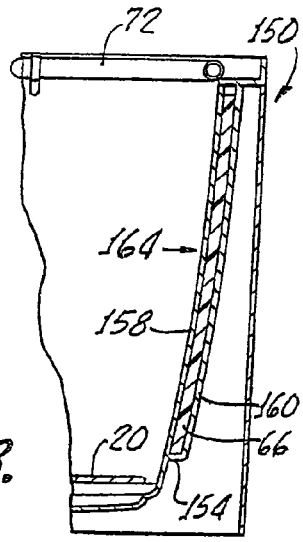
Figure 14:
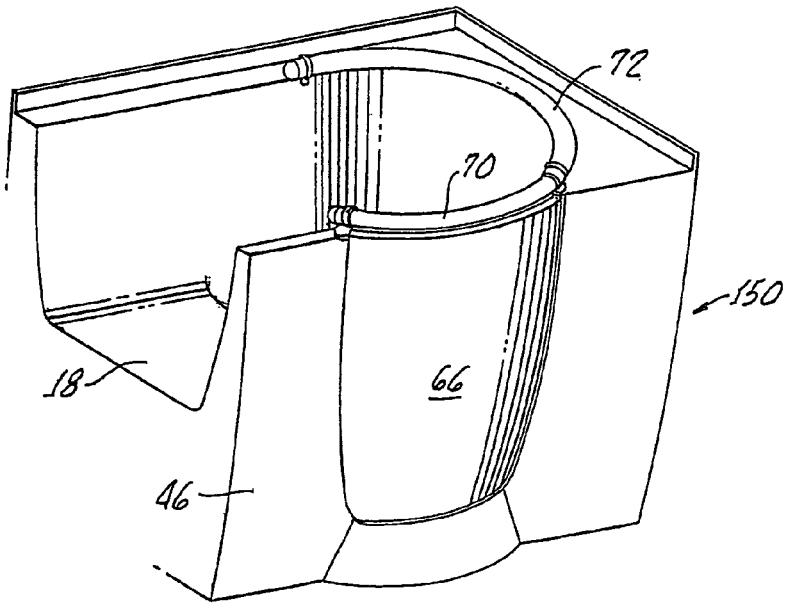

With reference to FIGS. 12-14, there is shown an alternative embodiment of the enclosure 150 in accordance with the present invention with identical or substantially similar components indicated by common character references as hereinbefore discussed in connection with the enclosure 10.

The enclosure 150 is substantially identical to the enclosure 10 except that the access door 66 is supported by a track 154 between an inside wall 158 and an outside wall 160 of a sidewall 164. Alternatively, the outside wall 160 may be eliminated with the door 66 being supported adjacent the wall 164 on an outside thereof by the track 154. Further features of the enclosure 150 are identical to the features of the enclosure 10 hereinabove described.

With reference now to FIGS. 15-25, there is shown bather 200 movement apparatus 202 in combination with the sidewall opening bath enclosure 10 hereinbefore described. Common character references represent identical or substantially similar components previously described.

Figure 19:
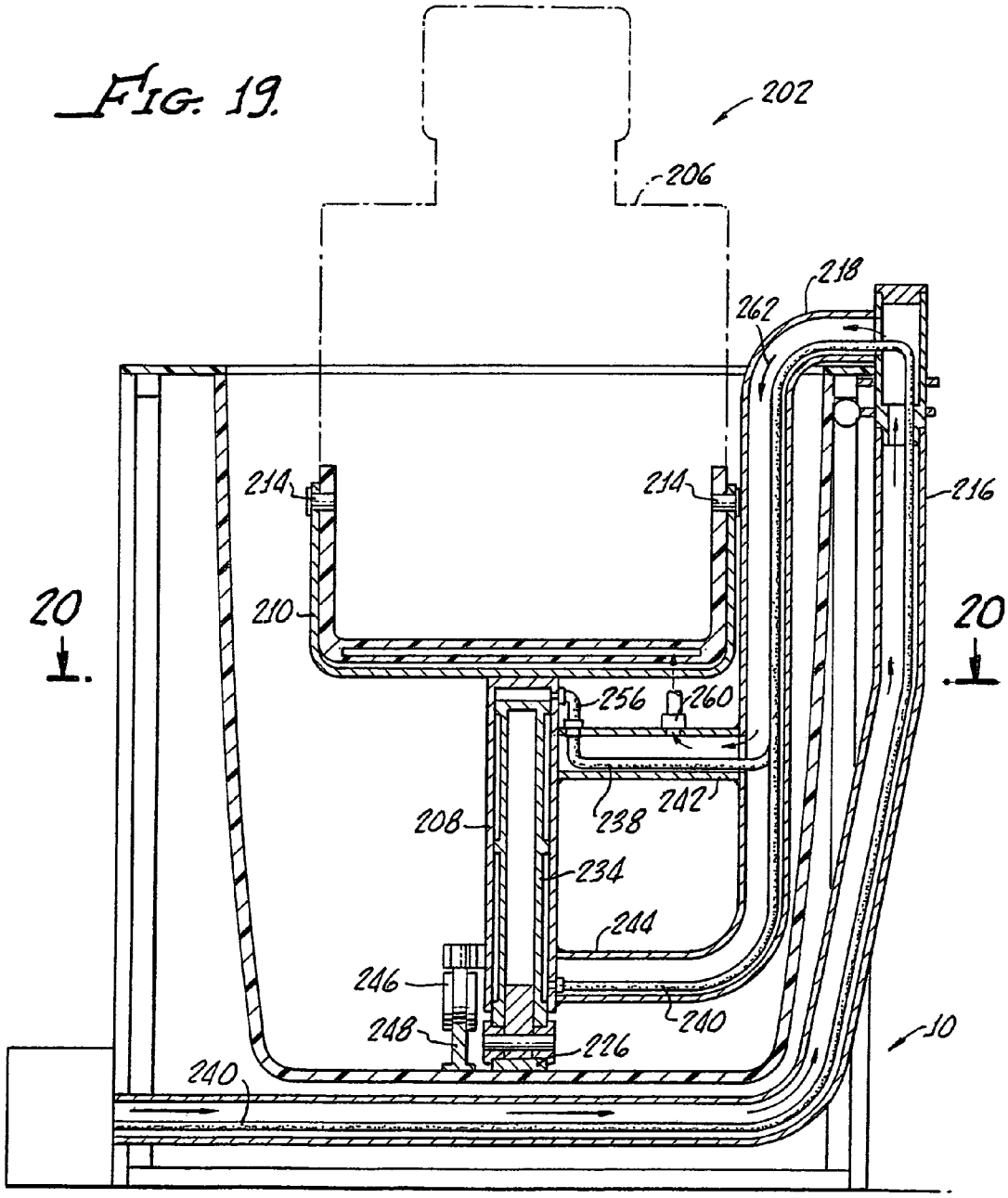
FIG. 19 is a cross sectional view taken along the line 19-19 of FIG. 10 illustrating the fluid mechanism of the present invention.

As best shown in FIG. 19, the bather movement apparatus 202 includes a chaise 206 along with a stanchion 208 and a stirrup 210 for supporting the chaise 206. As shown, the chaise 206 is swivel 214 mounted to the stirrup 210 for enabling the chaise 206 to be reclined within the bathing enclosure 10.

Figure 15:
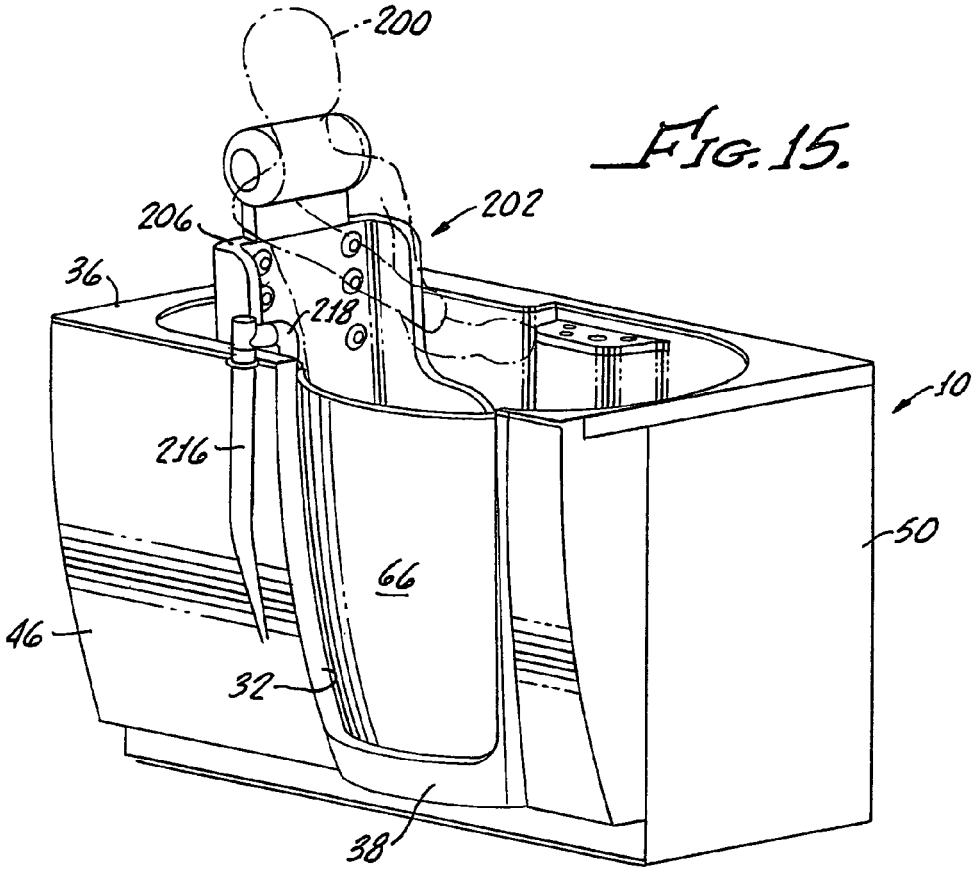
FIG. 15 is a perspective view of the bather movement apparatus in combination with a sidewall opening bath enclosure illustrating a bather in a sitting position on a chaise within the bath enclosure.
Figure 16:
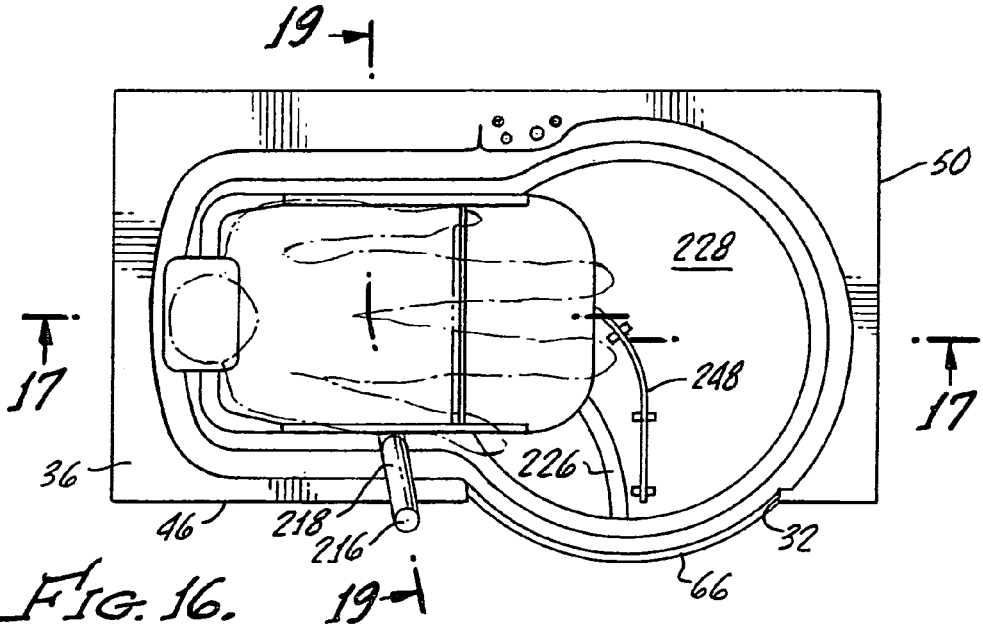
FIG. 16 is a top plan view of the apparatus and enclosure shown in FIG. 9 illustrating the bather in a supine position on the chaise along with a arcuate track disposed on a bottom of the bath enclosure for supporting the chaise.
Figure 17:
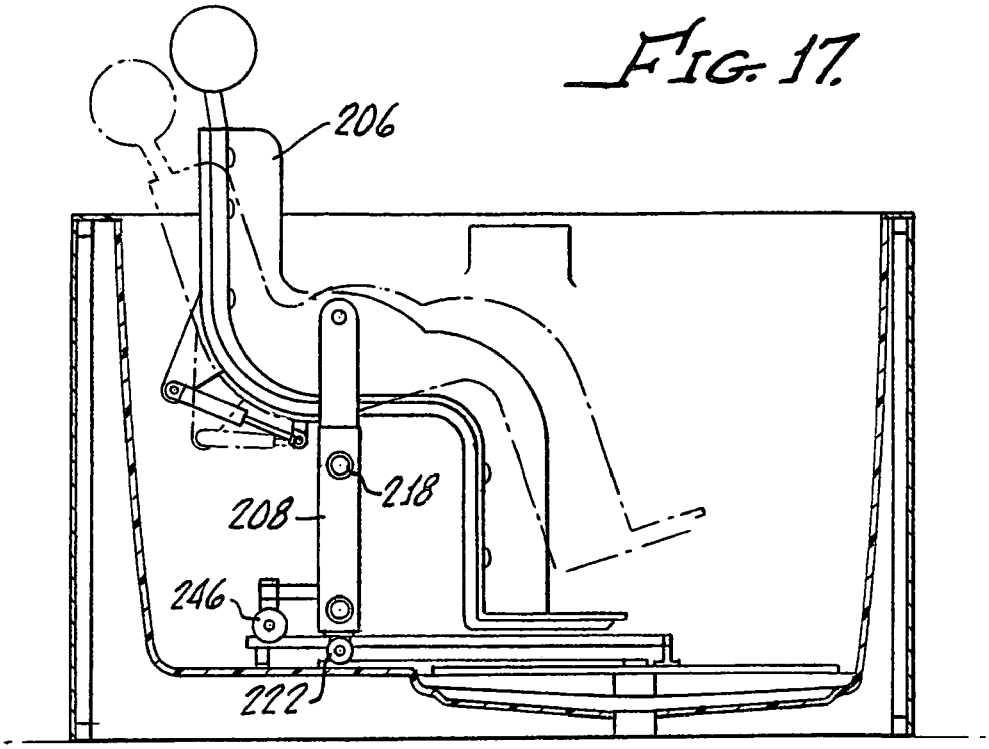
FIG. 17 is a cross sectional view of the apparatus in accordance with the present invention taken along line 17-17 of FIG. 16 illustrating a chaise being supported by a post and stirrup before enabling supine positioning of the bather.
Figure 18:
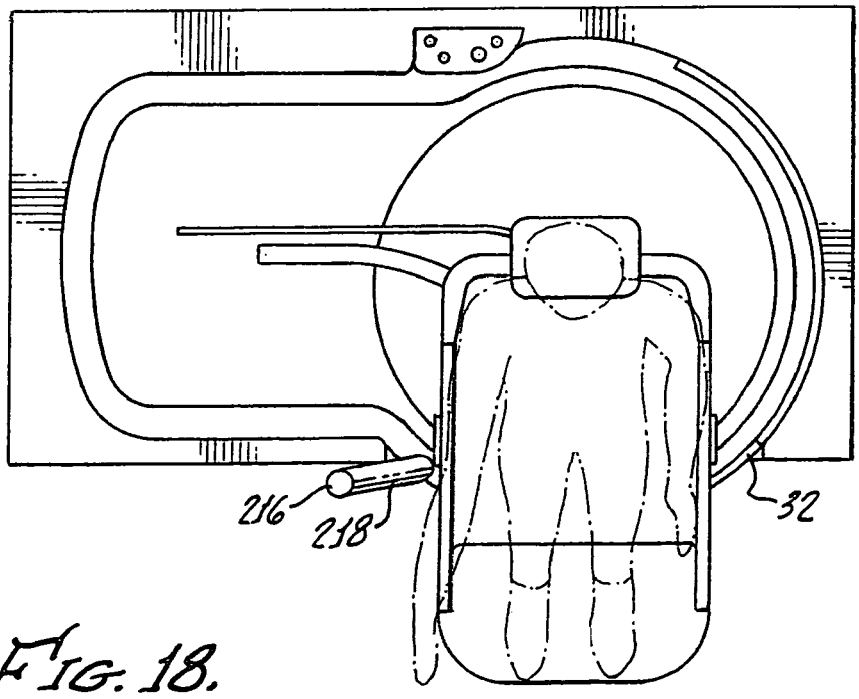
FIG. 18 is a top plan view of the apparatus in accordance with the present invention illustrating movement of the chaise through a bath enclosure side opening to a doorway position outside the bath enclosure.
Figure 21:
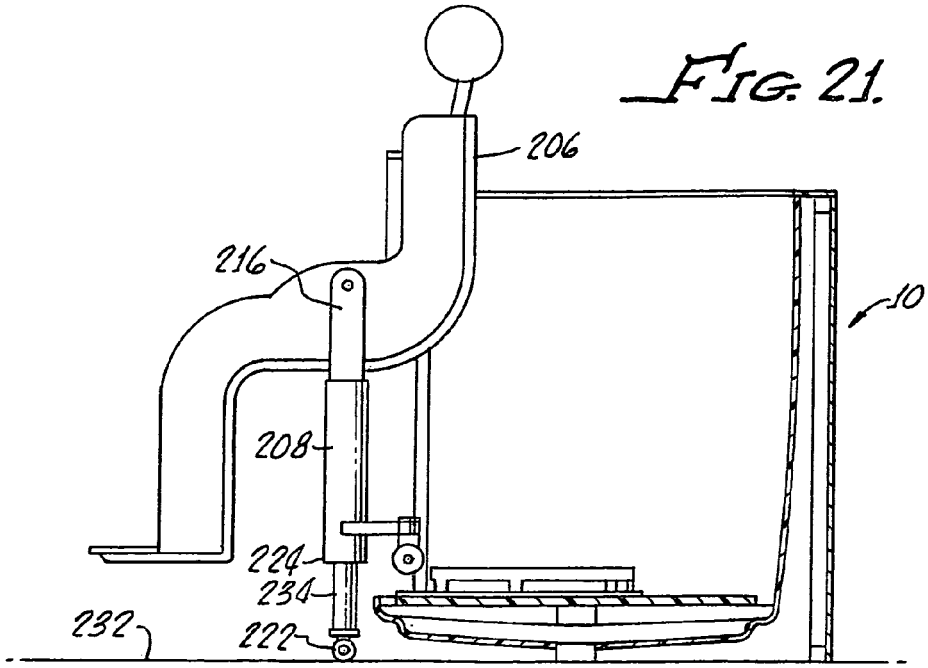
FIG. 21 is a side cross sectional view corresponding to the bather in a doorway position as shown in FIG. 18.

A pivot post 216 extending exterior to the bath enclosure 10 along with a pivot arm 218 supporting the stanchion enables arcuate movement of the chaise 206 between a bathing position shown in FIGS. 15, 16, and 17 and a doorway position shown in FIGS. 18 and 21. Movement from the bathing position to the doorway position passes the chaise 206 through the bath enclosure 10 side open 32.

As best shown in FIGS. 17 and 21, a roller 222 disposed at stanchion bottom 224 and arcuate track 226 disposed on a bath enclosure bottom 228 support the stanchion and chaise both within the bath enclosure 10 and exterior to the bath enclosure as shown in FIG. 21 which shows the roller 222 extendable from the stanchion bottom 224 to bear on a floor 232 outside of the bath enclosure 10, with the roller 222 being extendable by way of a piston 234 hydraulically operated by way of hydraulic lines 238, 240 disposed in sub-arms 242, 244 interconnected between the pivot arm 218 and the stanchion 208.

Figure 20:
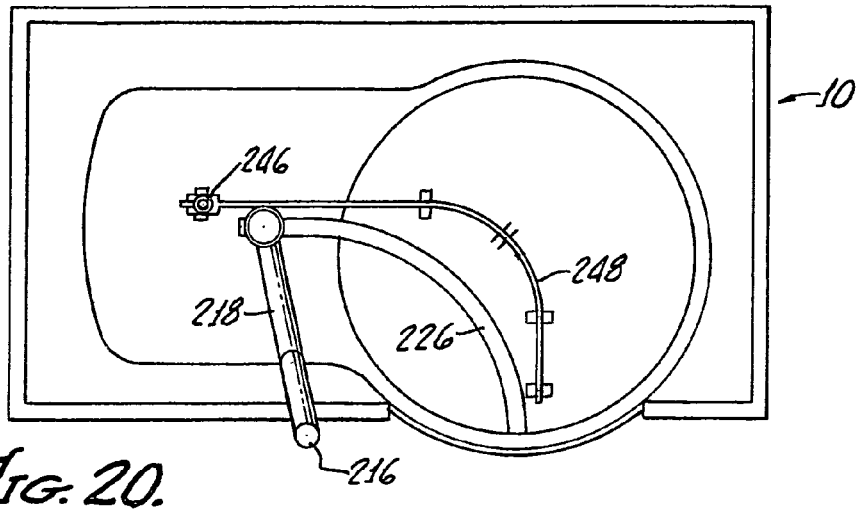
FIG. 20 is a view taken along the line 20-20 of the FIG. 19 illustrating an arcuate track disposed on the bath enclosure bottom along with a steering wheel.

With specific reference to FIGS. 19 and 20, a guide wheel 246 disposed at the stanchion bottom 224 engages an arcuate steering rail 248 during movement of the chaise 206 within the bath enclosure 10 for rotating the chaise 206 90° as the chaise is moved from the bathing position to the doorway position as hereinabove shown.

Figure 22:
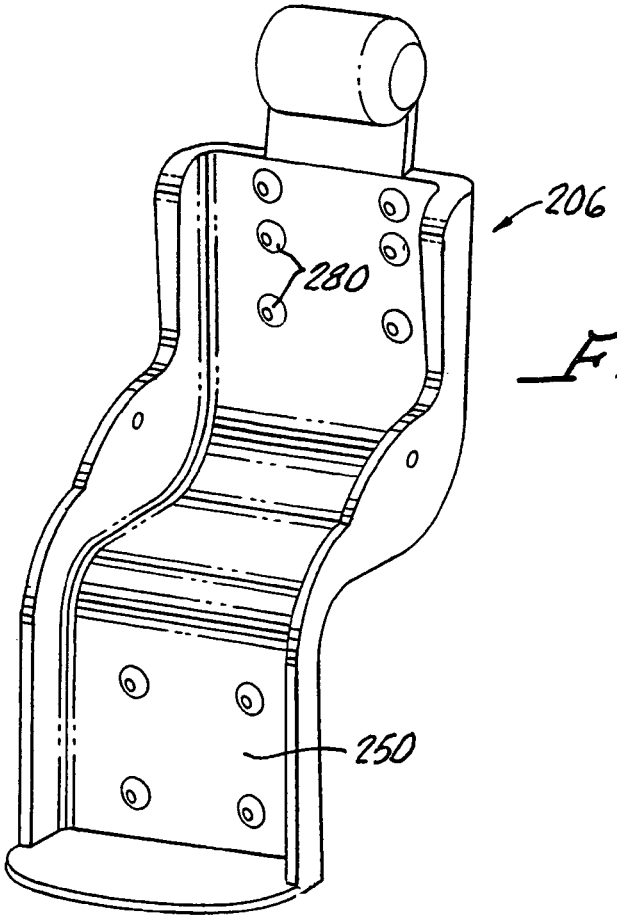
FIG. 22 is a perspective view of the chaise in accordance with the present invention showing massage nozzles for providing therapy to a bather, not shown.
Figure 23:
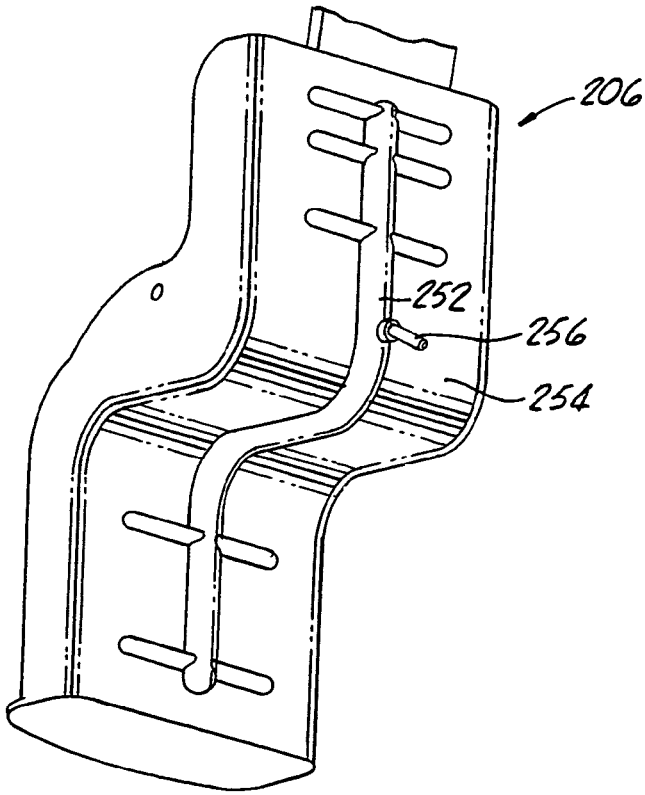
FIG. 23 is a perspective view of the back side of the chaise shown in FIG. 22 illustrating molded fluid channels in fluid communication with the massage nozzles.

With reference to FIGS. 22 and 23, the chaise 206 may include a plurality of massage nozzles for either air or water therapy which are in fluid communication with channels 252 disposed on a back 254 which are fed by flexible tube 256 connected by a fitting 258 with the sub-arm 242, pivot arm 218, and pivot post 216 for receiving a supply of air or water as indicated by the arrow 262 in FIG. 19.

Figure 24:
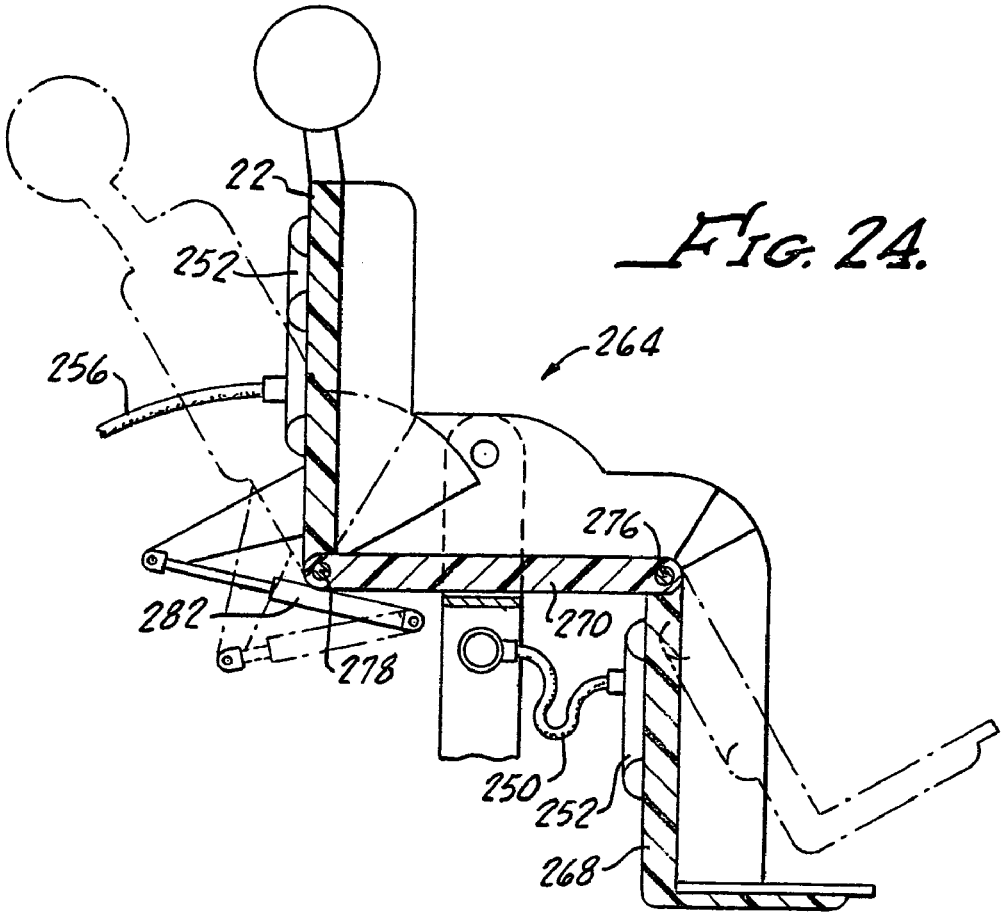
FIG. 24 is a side view of an alternative embodiment of the present invention in which the chaise is articulated at both hip and knee positions.
Figure 25:
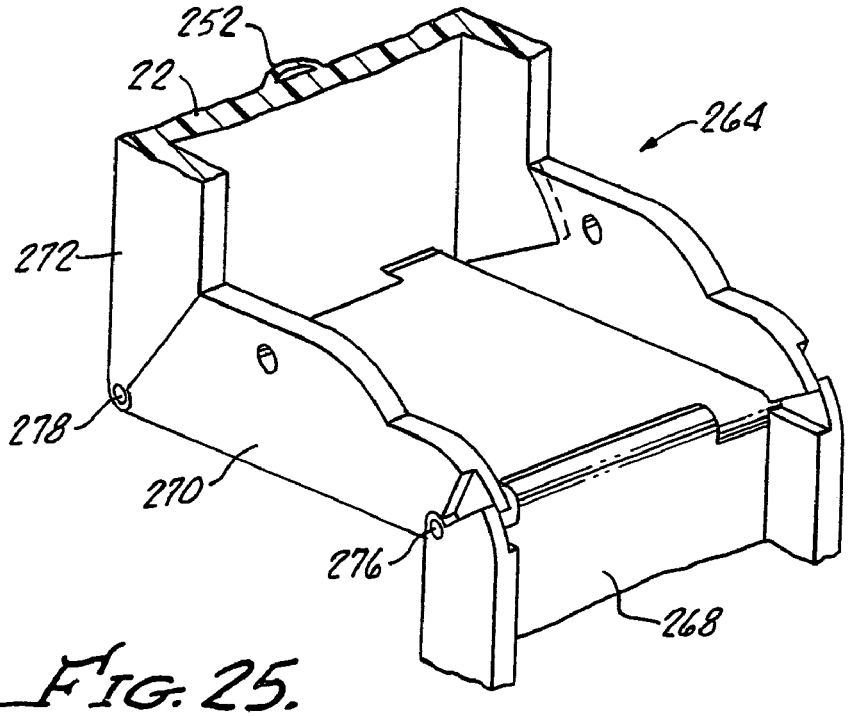
FIG. 25 is a perspective view of the chaise seat illustrating articulated side walls.

Alternatively, as shown in FIGS. 24 and 25, an articulated chaise 264 may be utilized having a leg portion 268, seat portion 270, and back portion 272 interconnected by pins 276, 278 or the like with the angular relationship between the leg portion 268, seat portion 270, and back portion 272 being controlled by a hydraulic piston 282 in a conventional mariner and operated through the fluid communication with the pivot post 216, pivot arm 218, and sub-arms 242, 244.

It should be appreciated that all the functions of the bather movement apparatus are implemented with conventional hydraulics and a convenient control panel 286 provided for use by the bather 200.

Although there has been hereinabove described a specific bather movement apparatus for use with a side opening bath enclosure in accordance with the present invention for the purpose of illustrating the manner in which the invention may be used to advantage, it should be appreciated that the invention is not limited thereto. That is, the present invention may suitably comprise, consist of or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. Bather movement apparatus for use with a sidewall opening bath enclosure, the apparatus comprising:

a chaise;

a stanchion having a stirrup for supporting said chaise;

a pivot post extending exterior to the bath enclosure;

a pivot arm interconnecting said pivot post with said stanchion and enabling arcuate movement of said chaise between a bathing position within the bath enclosure and a doorway position outside of the bath enclosure, the movement passing said chaise through the bath enclosure side opening;

a roller disposed at a stanchion bottom, said roller being extendable from said stanchion bottom for bearing on a floor outside of the bath enclosure;

an arcuate track disposed on a bath enclosure bottom for supporting the roller, stanchion and chaise within the bath enclosure; and a piston disposed in said stanchion for raising and lowering said stirrup and chaise as well as extending said roller from said stanchion bottom to bear on the floor outside of the bath enclosure.

2. The apparatus according to claim 1 further comprising a guide wheel disposed at the stanchion bottom and an arcuate steering rail adjacent the track, said guide wheel engaging the steering rail during movement of said chaise within the bath enclosure and rotating said chaise 90 degrees from the bathing position to the doorway position.

3. The apparatus according to claim 1 wherein said chaise is hinge mounted to said stirrup for enabling supine positioning of said chaise within the bath enclosure.

4. The apparatus according to claim 1 wherein said chaise is articulated for enabling a bather, positioned in said chaise, to assume various anatomical contours.

5. The apparatus according to claim 1 wherein said chaise includes massage nozzles for providing therapy to a bather.

6. The apparatus according to claim 5 wherein said chaise includes molded fluid channels on a chaise back in fluid communication with said massage nozzle.

7. The apparatus according to claim 6 wherein the stanchion, pivot arm, and pivot post are in fluid communication with the chaise channels and nozzle.

8. Bather movement apparatus comprising:

a sidewall opening bath enclosure;

a chaise;

a stanchion having a stirrup for supporting said chaise;

a pivot post extending exterior to the bath enclosure; and a pivot arm interconnecting said pivot port with said stanchion and enabling arcuate movement of said chaise between a bathing position within the bathing enclosure and a doorway position outside of the bath enclosure, the movement passing said chaise through the bath enclosure side opening;

a roller disposed at a stanchion bottom, said roller being extendable from said stanchion bottom for bearing on a floor outside of the bath enclosure;

an arcuate track disposed on a bath enclosure bottom for supporting the roller, stanchion and chaise within the bath enclosure; and a piston disposed in said stanchion for raising and lowering said stirrup and chaise as well as extending said roller from said stanchion bottom to bear on the floor outside of the bath enclosure.

9. The apparatus according to claim 8 further comprising a guide wheel disposed at the stanchion bottom and an arcuate steering rail adjacent the track, said guide wheel engaging the steering rail during movement of said chaise within the bath enclosure and rotating said chaise 90 degrees as the chair is moved between the bathing position and the doorway position.

10. The apparatus according to claim 8 wherein said chaise is hinge mounted to said stirrup for enabling supine positioning of said chaise within the bath enclosure.

11. The apparatus according to claim 8 wherein said chaise is articulated for enabling a bather, positioned in said chaise, to assume various anatomical contours.

12. The apparatus according to claim 8 wherein said chaise includes massage nozzles for providing therapy to a bather.

13. The apparatus according to claim 12 wherein said chaise includes molded fluid channels on a chaise back in fluid communication with said massage nozzle.

14. The apparatus according to claim 13 wherein the stanchion, pivot arm, and pivot post are in fluid communication with the chaise channels and nozzle.

* * * * *